United States Patent [19]

Resta et al.

[11] Patent Number: 4,838,186

[45] Date of Patent: Jun. 13, 1989

[54] AUTOMATIC APPARATUS FOR THE MANUFACTURE OF MATTRESS-SACKS

[75] Inventors: Rodolfo Resta; Mario Resta; Roberto Resta, all of Faenza, Italy

[73] Assignee: Resta Commerciale S.r.l., Faenza, Italy

[21] Appl. No.: 96,192

[22] Filed: Sep. 14, 1987

[30] Foreign Application Priority Data

Sep. 26, 1986 [IT] Italy ..... 3522 A/86

[51] Int. Cl.[4] ..... D05B 11/00; D05B 21/00

[52] U.S. Cl. ..... 112/2.1; 112/309; 112/311

[58] Field of Search ..... 112/3 R, 309, 121.12, 112/262.3, 2, 121.15, 308, 262.1, 311, 2.1, 121.11

[56] References Cited

U.S. PATENT DOCUMENTS

| | | | |
|---|---|---|---|
| 3,722,441 | 2/1973 | Kitchener et al. | 112/309 |
| 3,752,097 | 8/1973 | Fuller, Jr. et al. | 112/121.12 |
| 4,155,317 | 5/1979 | Enomoto | 112/3 R |
| 4,685,408 | 8/1987 | Frye | 112/262.3 |

FOREIGN PATENT DOCUMENTS

| | | | |
|---|---|---|---|
| 1302988 | 2/1971 | Fed. Rep. of Germany | 112/121.11 |
| 3139426 | 4/1983 | Fed. Rep. of Germany | 112/309 |
| 1567893 | 9/1967 | France | 112/309 |

*Primary Examiner*—Peter Nerbun

*Attorney, Agent, or Firm*—Guido Modiano; Albert Josif

[57] ABSTRACT

The automatic apparatus for the manufacture of mattress-sacks includes: a base plane supporting the sack to be manufactured and having a work side, a sewing machine overhanging by said side and adapted to operate along a border of the sack parallel to said side, an auxiliary work plane rotatable on said base plane about a vertical axis, and presser elements rotatably supported about the same vertical axis and adapted to secure on said rotatable plane the border of the sack being sewn so as to allow its rotation for the sewing of a following border perpendicular to the preceding one.

6 Claims, 3 Drawing Sheets

1
30
9
8
12
28
7
5a
19
21
24
A
B
23
22
18
19
5

AUTOMATIC APPARATUS FOR THE MANUFACTURE OF MATTRESS-SACKS

BACKGROUND OF THE INVENTION

The present invention relates to an automatic apparatus for the manufacture of mattress-sacks.

As is known, mattresses of the type having springs and the like are outwardly lined by a sack generally consisting of a pair of quilted panels joined by a perimetral band. The sack containment borders are provided by strips sewn astride the adjacent borders of the panels and of the perimetral band.

In order to manufacture said mattress-sacks, conventional sewing machines are usually employed. This entails by no means small difficulties for the operator assigned to the manufacture operation, due to the considerable dimensions and to the weight of the parts to be joined. It is in fact obvious that it is necessary to rotate the quilted panels perpendicularly more than once on the work plane, in order to sew the perimetral band along their various sides. It is furthermore often observed that during sewing, creases form between the panels and the perimetral band such as to compromise the quality of the product.

SUMMARY OF THE INVENTION

The aim of the present invention is to eliminate the above described disadvantages by devising an apparatus which allows to perform the manufacture of mattress-sacks in an automatic manner, allowing in particular to easily perform their perimetral sewing.

Within the scope of this aim, a further object of the invention is to provide an apparatus which is simple in concept as well as safely reliable in operation and versatile in use.

This aim and this object are both achieved, according to the invention, by the present automatic apparatus for the manufacture of mattress-sacks, characterized in that it comprises a base plane for the sack to be manufactured provided with a work side, a sewing machine is supported and overhanging by said side and adapted to operate along a border of said sack parallel to said side, an auxiliary work plane rotatable on said base plane about a vertical axis, and presser elements rotatably supported about the same axis and adapted to secure on said rotatable plane said border of said sack being sewn so as to allow its rotation for the sewing of a following border perpendicular to said border.

BRIEF DESCRIPTION OF THE DRAWINGS

The details of the invention will become apparent from the detailed description of a preferred embodiment of the apparatus for the manufacture of mattress-sacks, illustrated only by way of non-limitative example in the accompanying drawings, wherein.

DESCRIPTION OF THE PREFERRED EMBODIMENTS

Figure 3:
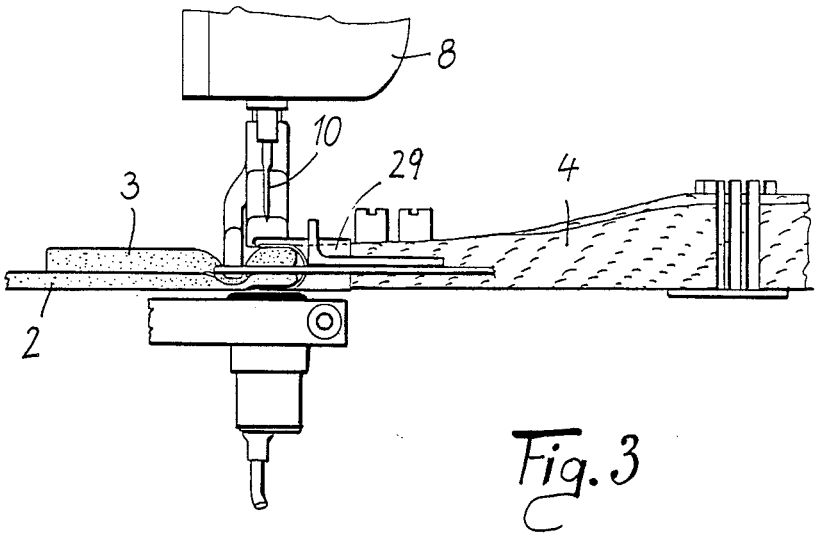
FIGS. 3 and 4 are, respectively, a vertical cross section and a top plan detail view of the sewing region.
Figure 4:
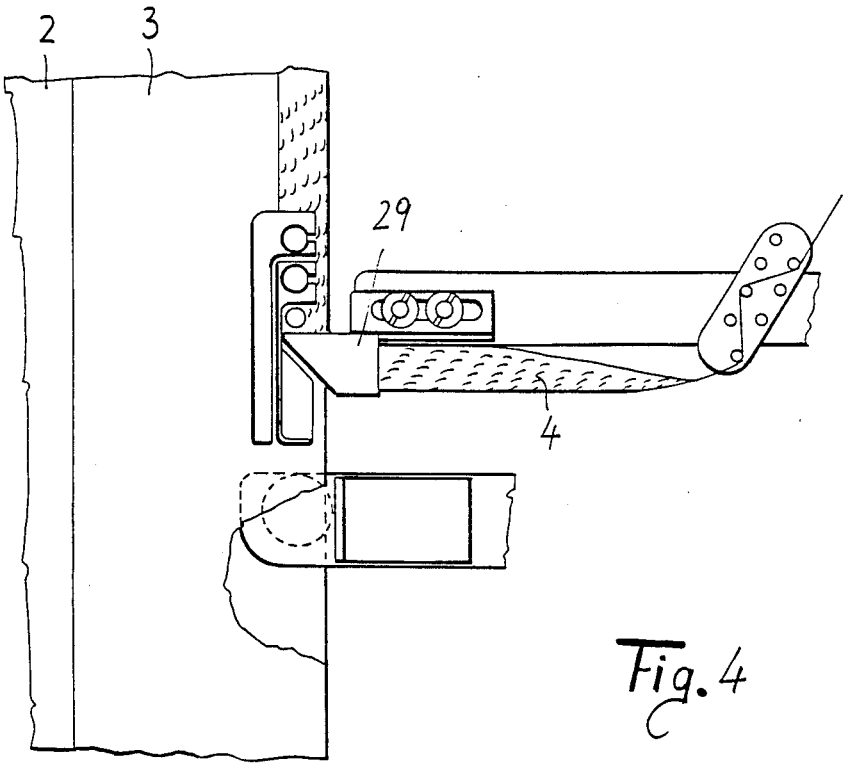

With particular reference to said figures, the reference numeral 1 generally indicates the apparatus for the manufacture of mattress-sacks substantially consisting of a pair of panels 2, for example of the quilted type, perimetrally joined by a band 3. FIG. 3 illustrates the step in which the band 3 is superimposed on a panel 2 so that the borders are perfectly overlapping in order to be covered by a strip 4.

The apparatus 1 comprises a base plane 5, for the sack being manufactued, which is rectangular and is mounted on an adapted base 6. A bracket 7 extends co-planar and centrally with respect to the work side 5*a* of the base plane 5, and is apapted to support a sewing machine 8 actuated by an adapted drive element 9. The sewing machine 8 is therefore arranged overhanging from the base plane 5, with the arm which supports the operating head arranged perpendicular to the work side 5*a* and the needle 10 vertically aligned with said side 5*a*.

An upright 11 is rigidly associated with the bracket 7, and a pair of horizontally parallel arms, upper 12 and lower 13 with respect to the bracket, extend from said upright. The arms 12, 13 are provided, at their ends, with respective brackets 14, 15 adapted to support related small shafts 16, 17 which are both coaxial to the needle 10 of the sewing machine, the small shaft 16 being rotatable, while the small shaft 17 is fixed.

The small shaft 16 is rigidly associated with a frame 18 which is horizontally V-shaped and provided at its ends with a pair of jacks 19 with a vertical axis which are adapted to actuate respective downwardly directed presser elements 20. The small shaft 16, rotatable on adapted bearings, is controlled in its rotation in alternate directions by a gear, composed of a pinion keyed to the small shaft 16 and of a rack provided on the stem of a double cylinder 21 rigidly associated with the bracket 14.

When lowered, the pressers 20, abut on an auxiliary work plane 22 rotatable about an axis defined by the small shaft 17. The rotatable plane 22 is constituted by a circular sector slightly wider than a quarter of a circle, conveniently inserted in a semicircular recess 23 of the resting plane 5. The recess 23 is adapted to allow the rotatable plane 22 to rotate through 90°, this rotation being limited by a shoulder 24 arranged along the work side 5a of the base plane 5.

The rotatable plane 22 is rigidly associated by means of a lower flap 25 with a sleeve 26 which is mounted rotatable, by means of bearings, on the small shaft 17. A flexible plate 27 is radially associated with the fixed shaft 17 and is provided, at its end, with a slot 27*a* in which a head-shaped pivot 25*a* engages and is rigidly associated with the flap 25. The flexible plate 27 acts as a spring to return back the flap 25, and therefore the plane 22, at the end of each rotation.

The strip 4 is fed by a reel 28 mounted on the bracket 7 and is driven through a creaser 29 adapted to arrange it in a known manner on the overlapping borders of the quilted panel 2 and of the perimetral band 3 at the sewing region of the needle 10.

Figure 1:
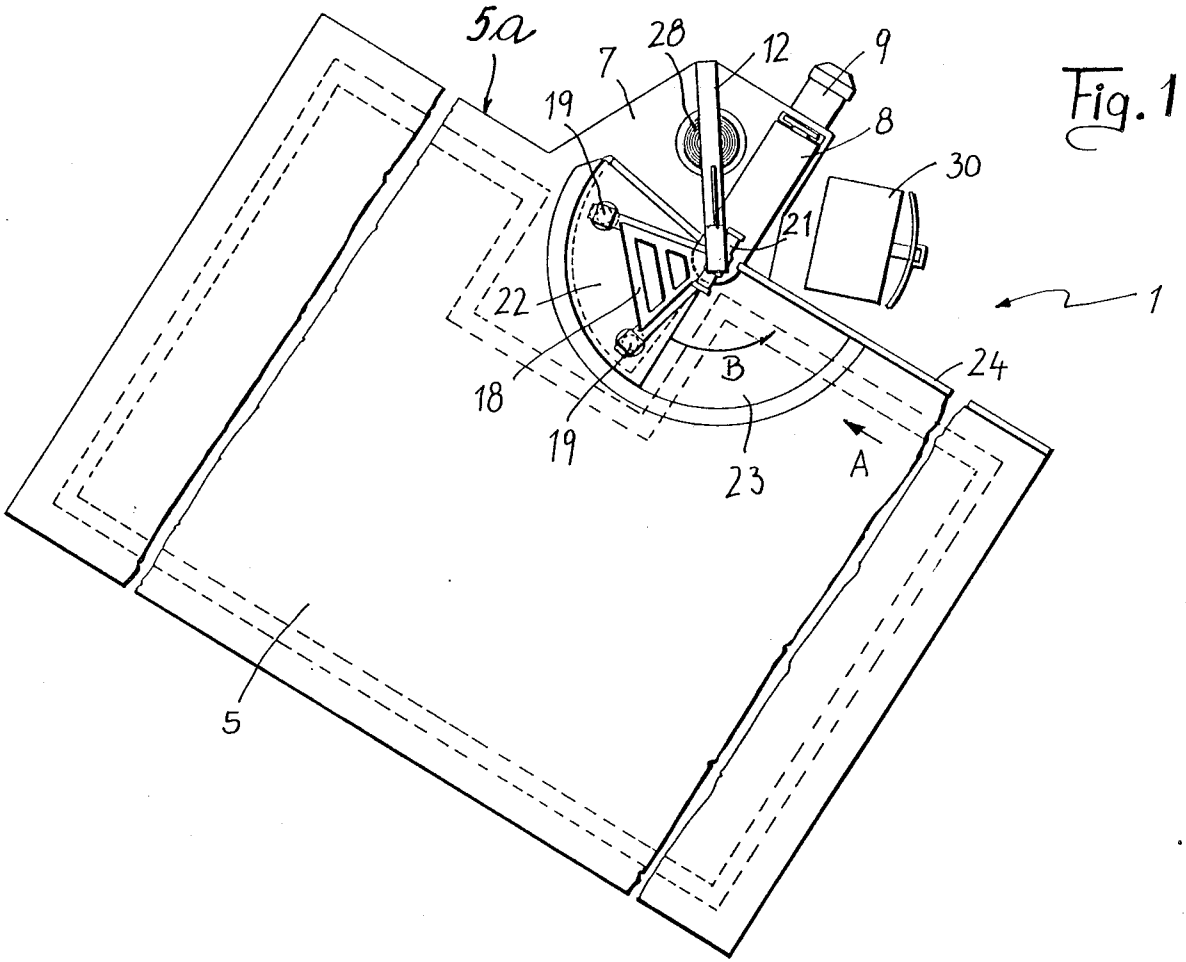
FIG. 1 is a top plan view of the apparatus according to the invention.
Figure 2:
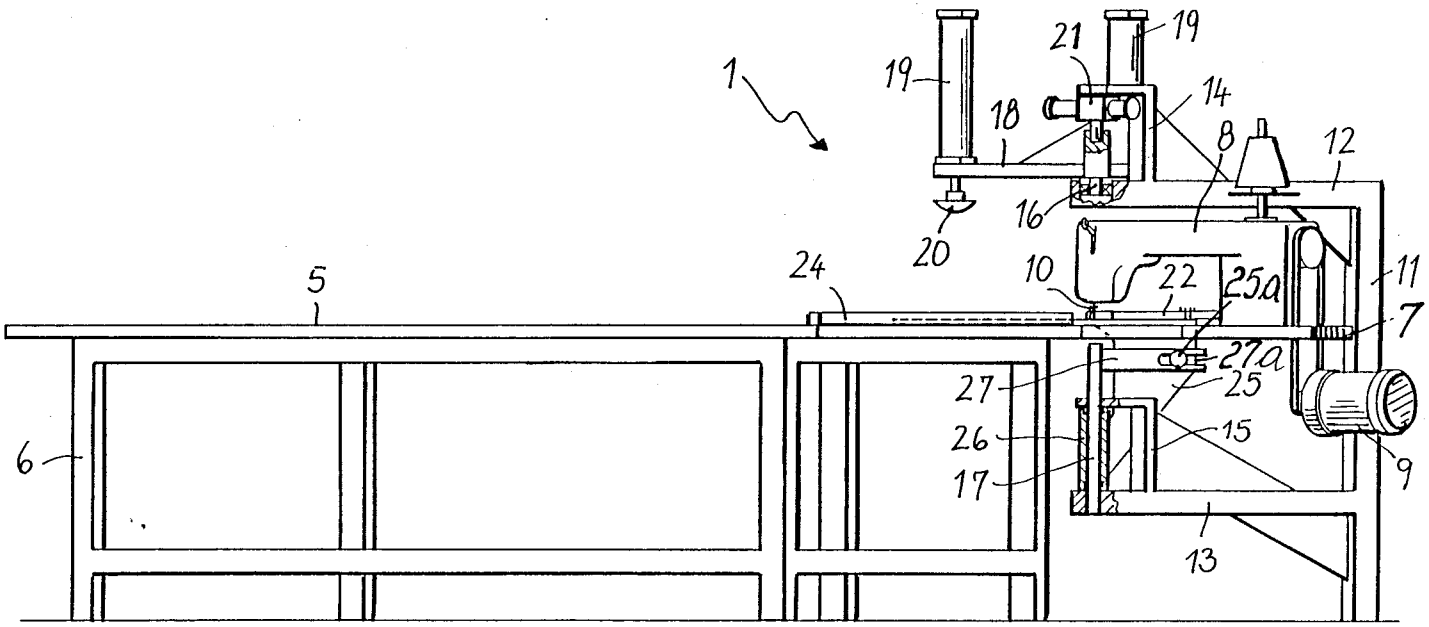
FIG. 2 is a side elevation view thereof in partial cross section.

The panel 2 and the band 3 are made to advance on the base plane 5 in the direction indicated by the arrow A in FIG. 1, advantageously guided by the shoulder 24. Once the sewing of one side of the sack has been completed, leaving the needle 10 stuck in the fabric of the sack, the lowering of the pressers 20 is actuated, so as to secure said sack on the rotatable plane 22, and the angular rotation of said plane 22 is subsequently actuated in the direction indicated by the arrow B. The rotation of the rotatable plane 22 is actuated by the double cylinder 21, which positively controls the frame 18 which is in turn rigidly associated with the plane 22 by the pressers 20.

The rotatable plane 22 rotates from the work position illustrated in FIG. 1 to an orthogonal position defined by the abutment on the shoulder 24. Thus the sack secured by the pressers 20 is also forced to rotate through 90°, so as to offer a new side to the sewing line of the machine 8. It should be particularly noted that the axis of rotation of the plane 22 and of the frame 18, defined by the small shafts 16 and 17, is coaxial to the needle 10 of the machine 8, so that said needle can remain engaged in the sack without interrupting the sewing, and acting as a rotation pivot for the sack.

Once the rotation of the sack has been performed, the raising of the pressers 20 and the return of frame 18 and of the rotatable plane 22 to their initial positions are actuated. The return of the frame 18 is actuated by the cylinder 21, while the return of the plane 22 is actuated by the flexible plate 27. At this point it is possible to resume the sewing of the strip 4 to the borders of the panel 2 and of the band 3 to continue the sewing along a new side of the sack.

The apparatus described therefore allows to manufacture mattress-sacks in a simple and rapid manner, in particular freeing the operator, who conveniently sits on a chair 30 in front of the sewing machine, from the task of rotating the sack. By means of adapted sensors it is furthermore possible to make the various functions of the apparatus completely automatic.

The invention described is susceptible to numerous modifications and variations. For example, the small shafts 16, 17, instead of being coaxial to the needle 10 of the sewing machine, may be fixed along an axis parallel to that of the needle. In this manner it is possible to produce an arc-shaped sewing.

According to another aspect, instead of the rack-and-pinion gear actuated by a double cylinder, the use is provided of an electromechanical system such as a clutch/free-wheel assembly. Similarly, the rotatable plane 22 can be actuated in its return stroke by an electromechanical device replacing the spring 27.

In the practical embodiment of the invention, the materials employed, the shapes and the dimensions may be any according to the requirements.

We claim:

1. Automatic apparatus for the manufacture of mattress-sacks, comprising a base plane for the sack to be manufactured provided with a work side, a sewing machine supported and overhanging by said side and adapted to operate along a border of said sack parallel to said side, an auxiliary work plane rotatable on said base plane about a vertical axis, and presser elements rotatably supported about said vertical axis and adapted to secure on said rotatable plane the border of said sack being sewn so as to allow its rotation for the sewing of a following border perpendicular to said border.

2. Apparatus according to claim 1, wherein said auxiliary work plane is rotatable between a position of support of the sack during the sewing step and a position rotated through 90° with respect to said position of support in order to define the rotation of said sack.

3. Apparatus according to claim 1, wherein said presser elements are actuated by related vertical jacks and are supported by a frame which is rotatable about said axis and actuated by alternating actuation means.

4. Apparatus according to claim 1, wherein said auxiliary work plane is rotatable in a recess of said base plane.

5. Apparatus according to claim 4, wherein said auxiliary work plane is defined by a circular sector substantially equal in width to a quarter of a circle and inserted in a semicircular recess of said base plane.

6. Apparatus according to claim 1, wherein said auxiliary work plane is actuated in a direction opposite to said rotation of the sack by spring means.

* * * * *